US005406732A

United States Patent [19]

Peterson

[11] Patent Number: 5,406,732

[45] Date of Patent: Apr. 18, 1995

[54] RIFLE/PISTOL REST

[76] Inventor: Thomas K. M. Peterson, 124 Stoney Point Rd., Courtland, Minn. 56021

[21] Appl. No.: 210,807

[22] Filed: Mar. 19, 1994

[51] Int. Cl.[6] ..... F41A 29/00

[52] U.S. Cl. ..... 42/94; 248/164

[58] Field of Search ..... 42/94; 89/37.04; 248/164, 166, 173, 176, 431, 440.1

[56] References Cited

U.S. PATENT DOCUMENTS 2,436,349 2/1948 Adams ..... 42/94

3,863,376 2/1975 Dalmaso ..... 248/166 X 4,017,997 4/1977 Peterson et al. ..... 42/94

*Primary Examiner*—Ramon O. Ramirez

*Attorney, Agent, or Firm*—Roger W. Jensen

[57] ABSTRACT

A shooting rest comprising a pair of elongated rods having a preselected cross section and a duplex function clamp means for receiving the rods and holding the rods with the longitudinal axes thereof being in a plurality of preselected angular relationships. The clamp means further permits the holding of the rods at a plurality of preselected locations along the longitudinal axes of the rods.

12 Claims, 3 Drawing Sheets

FIG. 1
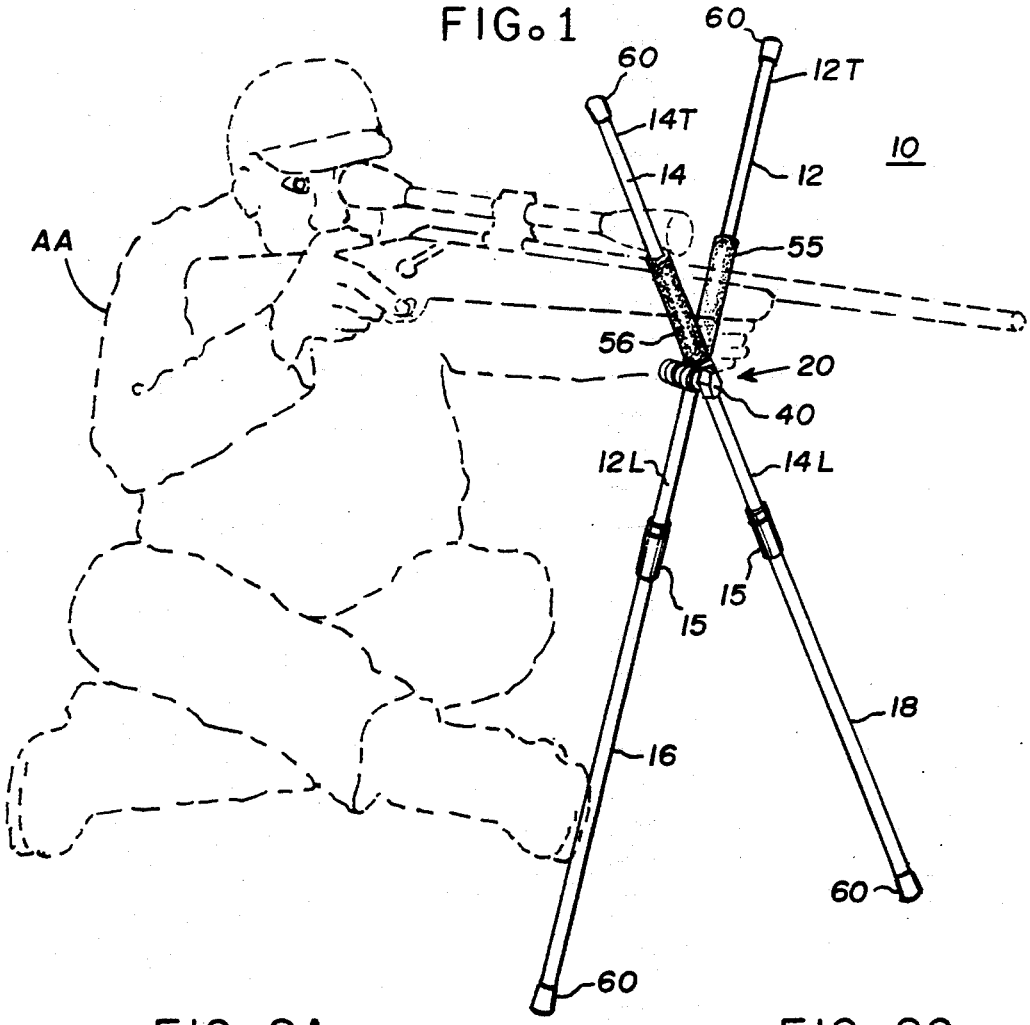
FIG. 2A
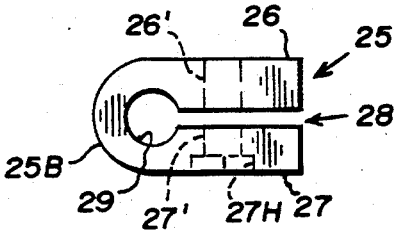
FIG. 2C
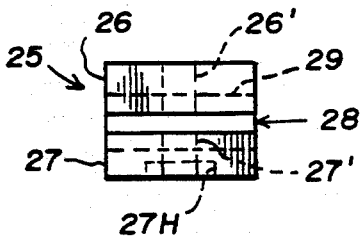
FIG. 2B
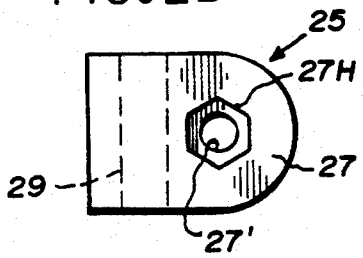
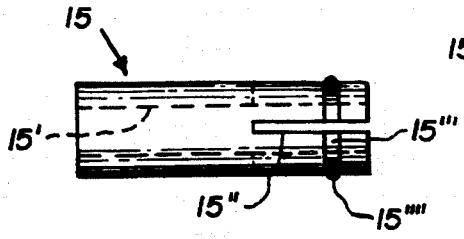
FIG. 3A
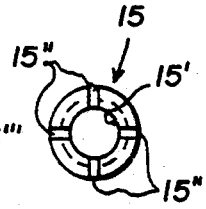
FIG. 3B

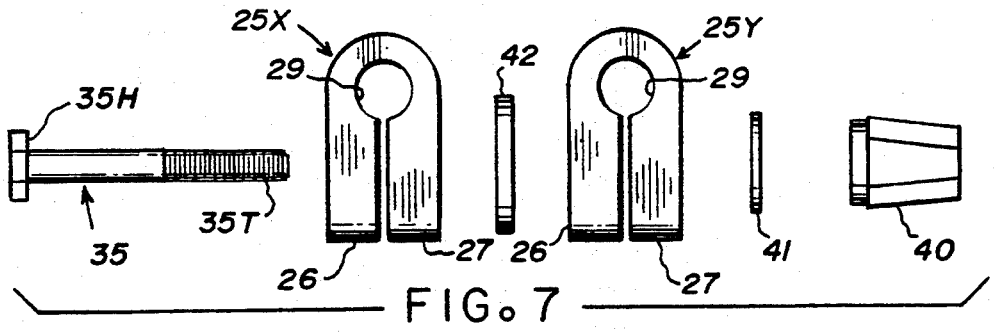
FIG. 7
FIG. 8
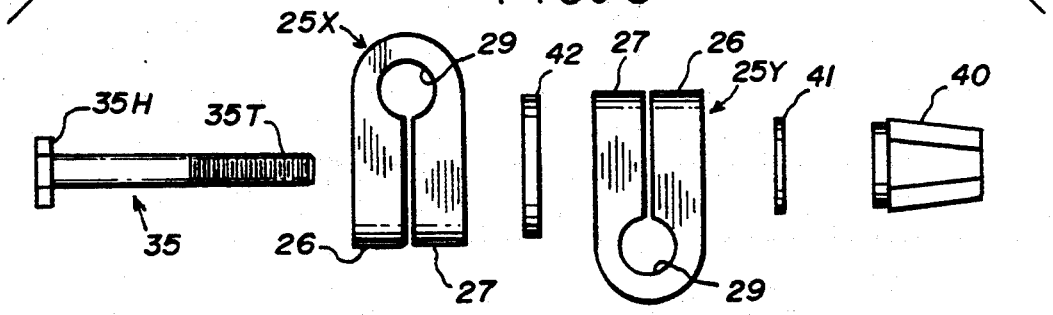
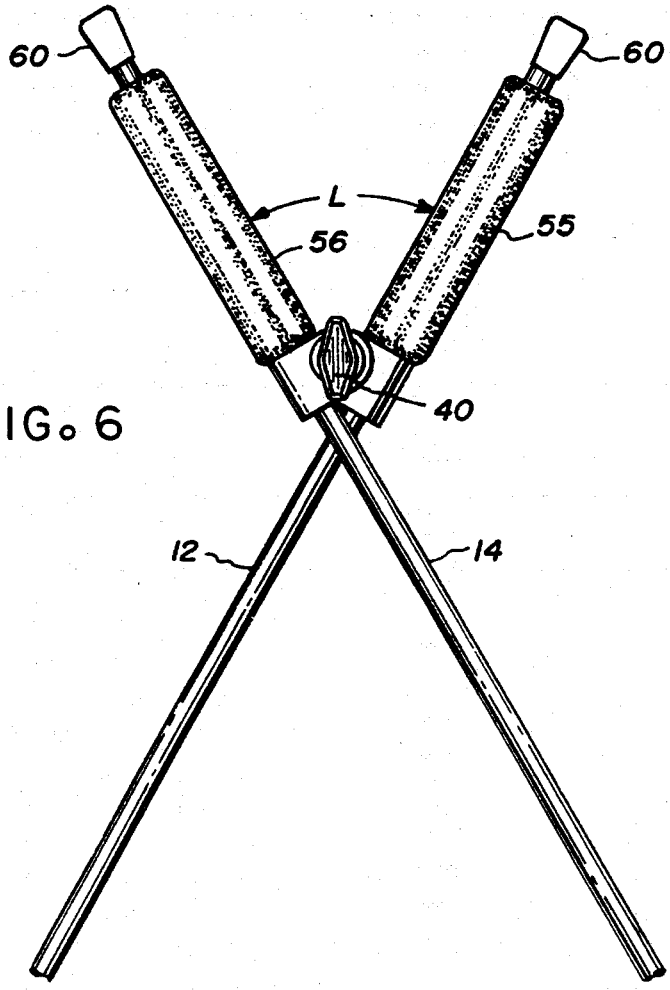
FIG. 6

RIFLE/PISTOL REST

FIELD AND BACKGROUND OF THE INVENTION

This invention relates to portable rests for shooters to rest their long-barreled firearms such as rifles or hand guns such as pistols and revolvers so as to facilitate long range accuracy in the shooting of the guns.

Those skilled in the art know of a variety of monopods, bipods and tripods for providing a shooting rest for marksmen. Each of the prior art arrangements has certain disadvantages.

My invention has several significant advantages over the prior art. My invention is a bipod but does not require any attachment to the firearm. It allows the firearm sights to be "placed on target" rapidly by the shooter and to track game or other moving targets without the shooter substantially changing position. The invention permits very fast height adjustment through the use of my unique slip/swivel/clamp for prone, sitting or kneeling positions from 6 inches to 36 inches. The sights on the firearm level instantly even if the shooter is on uneven ground. A "quick" coupler allows a quiet setup to minimize "spooking" wild game and also facilitates compact transport in the field. Protective sleeves are provided on the rods in the usage zone so as to protect gun stock finish.

SUMMARY OF THE INVENTION

My invention provides a shooting rest comprising a pair of elongated rods each having an upper end, a lower end and a preselected cross section. A key feature of my invention is a unique slip/swivel/clamp for holding the rods (i) with the longitudinal axes thereof in a plurality of preselected angular relationships and (ii) at a plurality of preselected locations along the longitudinal axes of the rods. The clamp means includes a pair of identical clamps each having a U-shape with a bight portion and two legs or sidewalls extending therefrom in a substantially parallel relationship with space provided between legs. A bore extends through the bight portion and has a cross section preselected to slidably receive the rods when the legs or sidewalls are parallel or substantially parallel, and to clamp the rods when the legs are moved toward one another. The bore also opens into the gap or space between the sidewalls or legs; this facilitates the aforesaid clamping of the rods. The clamps further have openings in the legs or sidewalls which are in mutual alignment with one another and have a common axis spaced from and perpendicular to the axis of the rod receiving bores. The clamp means further includes a bolt means having a head means and a threaded end the bolt means being insertable into the sidewall or leg openings and held therein under tension through coaction with a nut means threaded onto the threaded end. A recessed provision in the sidewall locks the bolt head. An elongated protective sleeve or tubular member preferably made of foam material is positioned around each of said rods between said upper ends and the clamps. A means is provided which allows extension legs to be added for increased elevation.

BRIEF DESCRIPTION OF THE DRAWINGS

FIG. 1 is a perspective view of a preferred embodiment of my shooting rest showing, in phantom, a seated shooter using the rest to steady a rifle;

FIGS. 2A, 2B and 2C are respectively side elevation, top and end views of a special unique slip/swivel/clamp two of which are used in the duplex function clamp means provided by this invention;

FIGS. 3A and 3B are a side view and end view of a collet type coupling for connecting extension rod means to the main rods;

FIG. 6 shows the invention assembled in a second mode; and

FIGS. 7 and 8 show the clamp assembly arrangement for the two modes shown respectively in FIGS. 4/5 and in FIG. 6.

DETAILED DESCRIPTION OF THE PREFERRED EMBODIMENT

Figure 4:
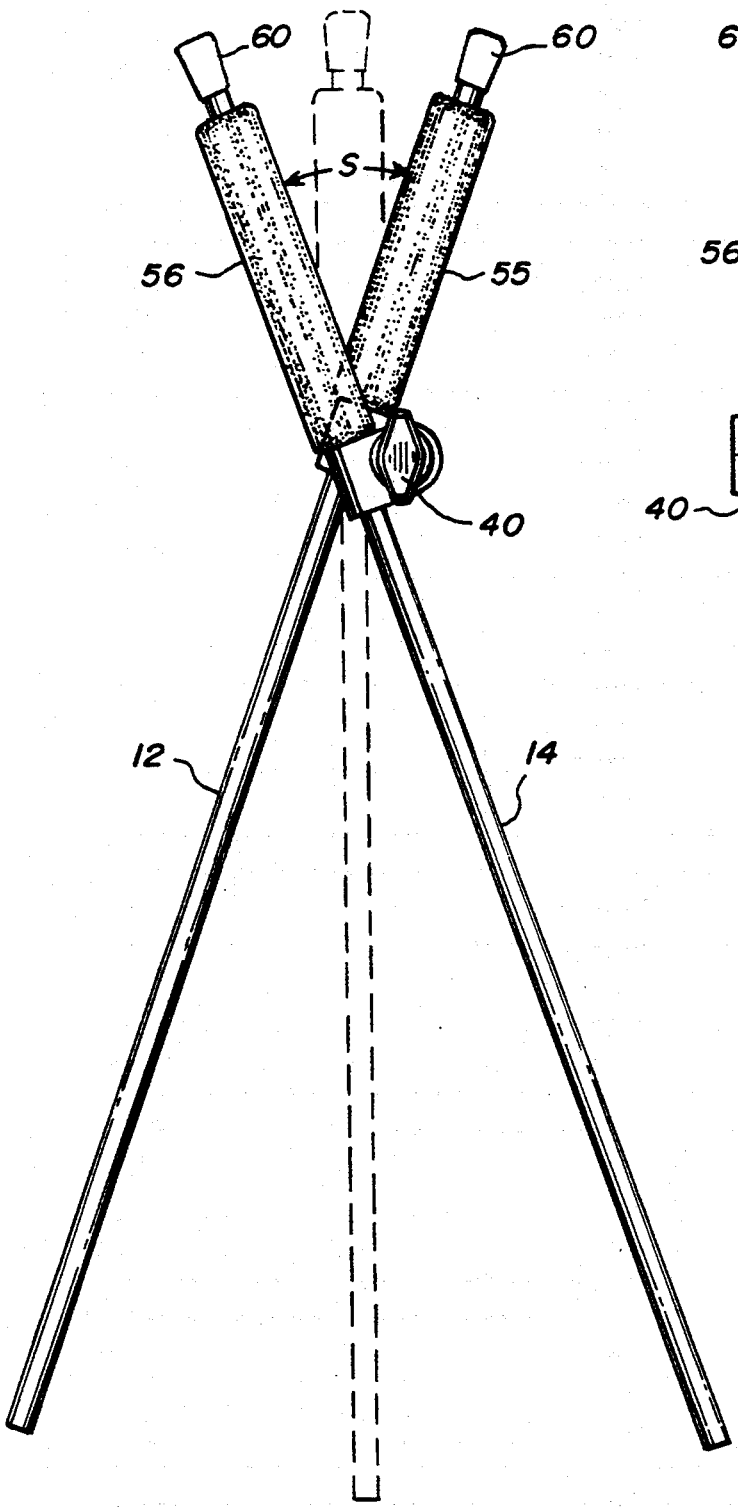
FIGS. 4 and 5 show the invention assembled in one mode.

In FIG. 1 is shown, in phantom, the shooter AA using the shooting rest generally designated by reference numeral 10 comprising a pair of elongated rods 12 and 14 each having upper or top ends 12T and. 14T and lower ends 12L and 14L. The rods preferably have a circular cross section although the scope of this invention would include other cross sections such as square, oval, triangular, hexagon or other preselected cross section. The rods are preferably made of light weight material such as fiber glass rods but other plastic, wood or metal rods could be substituted.

If desired extension means can be used to raise the crossing point of the rods; as shown in FIG. 1 rod extensions 16 and 18 are coupled with coupling means 15 respectively to rods 12 and 14 to provide this function.

The invention further comprises a unique duplex function clamp means 20 for receiving the rods and (i) holding the rods with the longitudinal axes thereof in a plurality of preselected angular relationships and (ii) further holding the rods at a plurality of preselected locations along the longitudinal axes thereof. Referring to FIGS. 2A, 2B and 2C as well as to FIGS. 7 and 8, clamp means 20 comprises a pair of slip/swivel/clamps one of which is shown in FIGS. 2A, 2B and 2C and identified by reference numeral 25. Each clamp 25 has a generally U-shape with a bight portion 25B and two legs or sidewalls 26 and 27 extending therefrom in parallel or substantially parallel spaced apart relationship, a gap 28 being defined between the inner adjacent faces of the legs, the gap 28 communicating with a bore 29 extending through the bight portion 25B. Openings 26' and 27' are provided in the legs or sidewalls in mutual alignment with one another and having a common axis spaced from and generally perpendicular to the axis of the rod receiving bore 29. The clamps 25 may be made from plastic or other appropriate material such as stainless steel.

Bore 29 in the preferred embodiment is shown to be circular and is preselected in size, i.e., in cross section, so as to receive freely the rods 12 and 14 when the legs or sidewalls 26 and 27 of the clamps 25 are in the relaxed position as shown in FIGS. 2A, 2B and 2C. It will be understood that the cross section of bore 29 could be non-circular for the above described variations in the cross section of the rods, i.e., oval, triangular, square, etc.

Leg openings 26' and 27' are shown to be bores having circular cross sections and in mutual alignment with one another and having a common axis spaced from and generally perpendicular to the axis of the rod receiving bore 29. While bores 26' and 27' are of circular cross section in the preferred embodiment it should be understood that the openings could be of other cross section and also could be open notches, i.e. opening to the right as shown in FIG. 2A to the extremities of legs 26 and 27, this arrangement not being specifically shown in the drawings.

A recess 27H shown best in FIG. 2B has a hexagon shape for receiving (and locking against rotation) the hexagon head 35H of a bolt means 35 shown in FIGS. 7 and 8. The bolt means 35 has at the other end thread means 35T and the bolt has sufficient longitudinal length so as to be able to traverse a pair of the clamps through the openings 26' and 27' the said pair of clamps being identified by reference numerals 25X and 25Y in FIGS. 7 and 8. A spacer washer 42 having a central opening (not shown) which may be made from metal, rubber or plastic is positioned intermediate members 25X and. 25Y. A nut means 40 having internal threads (not shown) is adapted to be threaded onto the threaded end 35T of the bolt means 35 and has associated therewith a conventional flat washer means 41 also having a central opening (not shown).

The clamp members 25 have their outboard surfaces flat or planer and substantially parallel to one another when in the relaxed form shown in FIGS. 2A–2C. They thus can be assembled as shown in FIG. 7 with both of the bores 29 on the same side of the bolt 35. Alternatively the members 25 can be assembled as shown in FIG. 8 with clamp member 25Y being reversed as shown in FIG. 7 so that the bores 29 of members 25X and 25Y are respectively on opposite sides of the bolt 35.

In both cases when the bolt 35 is passed through the openings 26' and 27' of both members 25X and 25Y as well as the openings (not shown) in spacer washer 42 and regular washer 41 and threadably engaged by nut 40 then the operator AA can selectively control the rotation of the nut 40 on the threaded end 35T of the bolt 35 so as to vary the tension in the bolt and to thus vary the force applied to the outer surfaces of the legs 26 and 27. Thus as the nut 40 is tightened, the tension in bolt 35 is increased and the legs or sidewalls 26 and 27 of each clamp tend to move toward one another to reduce the gap 28 and to provide the important function of clamping the rod in the bore 29. Stated otherwise, when the apparatus is assembled such as shown in FIG. 1 with the nut 40 tightened then the assembled apparatus will be rigidly held in place. However, if the nut 40 is loosened then the rods are no longer clamped within bore 29 and thus the rods can be moved longitudinally along the axes within the bore 29 to new positions either simultaneously or independently depending on the force determined by the shooter. Also importantly the angular relationship of the longitudinal axes of the rods can be varied according to the wishes of the shooter. The arrangement shown in FIG. 1 depicts the nut 40 facing away from the shooter AA; in most cases the nut 40 would face toward the shooter.

The invention may also include protective sleeves in the form of elongated tubular members 55 and 56 which are adapted to be slipped over the upper portions of the rods; thus the sleeves have an inner diameter preselected to perform this function and have an outer diameter preselected to be in the range of $1\frac{1}{2}$ to 4 or 5 rod diameters. The material of members 55 and 56 is preferably a substantially soft material such as foam or sponge material which will permit the supporting of a gun barrel or gun stock without damaging the finish thereof, yet resilient enough that it does not compress during the operation of the firearm.

Figure 5:
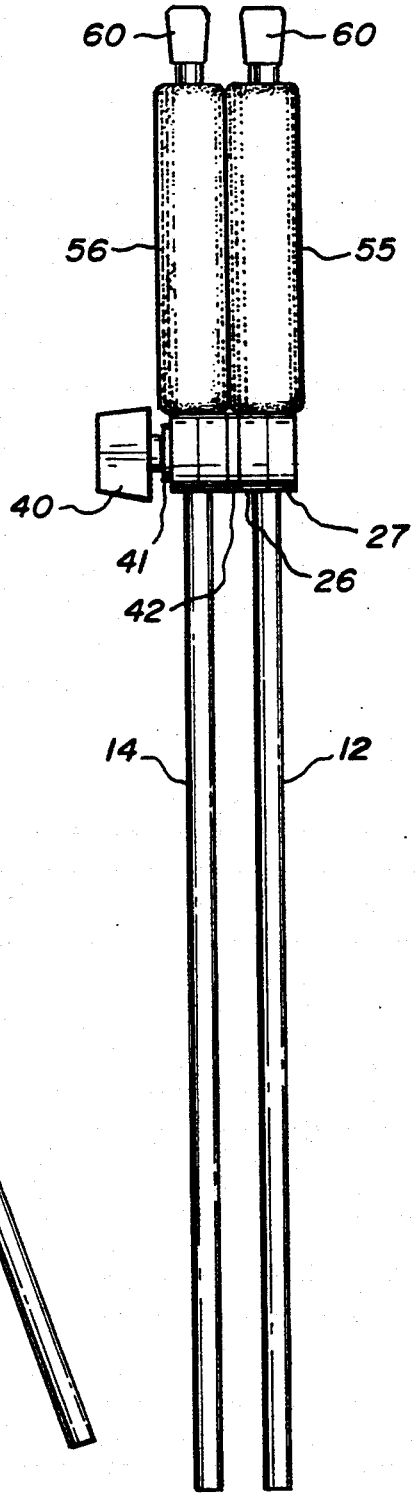

When the clamp means is assembled in accordance with the layout of FIG. 7 this produces the result shown in FIGS. 4 and 5 wherein it will be noted that the effective crossing of the upper portions of the legs, as buffered by sleeve members 55 and 56 prevents any contact by any part of the gun with the clamp means. The arcuate distance S between the sleeve members is relatively small; this configuration could be used to support a gun barrel. On the other hand if the layout of FIG. 8 is used then this produces the result shown in FIG. 6 where there is a greater arcuate distance L between the sleeve members 55 and 56; this arrangement could be used by a shooter having a gun with a fairly large forepiece gun stock.

The couplings 15 are shown in more detail in FIGS. 3A and 3B and comprise a cylindrical body of preselected length, outer diameter and bore 15'. A plurality of slits 15'' extend from one end a preselected distance longitudinally along the body. A circumferential notch 15''' adjacent to said end of coupling 15 provides a seat for an "O" ring 15'''' having a preselected resiliency. The body is made of an appropriate material such as steel or thermoplastic so as to have some spring characteristics. The aforedescribed arrangement provides for the connector 15 a collect or grasping effect or function. This permits a rapid insertion of the lower ends 12L and 14L into their respective connectors 15 whereat they are held until the shooter wants them removed.

The bores 15' are preselected (i) to grip, as aforesaid, the bottom or lower rod ends 12L and 14L through the aforesaid spring functions provided by slits 15'' and O-rings and (ii) to snugly receive the upper ends of the extension rods 16 and 18. The said upper ends of rods 16 and 18 are preferably held by adhesive within bore 15' of the couplings 15.

Stop and/or bumper means 60 are provided at the tops of 12 and 14 and at the bottom of 16 and 18; stop means 60 may be made of hard rubber or equivalent°

Those skilled in the art will understand that certain changes may be made in certain details to this invention particularly in the matters of shape, size and arrangement of parts and selection of materials without departing from the scope of the invention. The invention scope is set forth in the appended claims.

What is claimed is:

1. A shooting rest for both rifle and handgun shooters comprising:

(a) a pair of elongated rods each having an upper end, a lower end and a preselected cross section; and (b) a duplex function clamp means for receiving said rods and holding said rods with the longitudinal axes thereof in a plurality of preselected angular relationships and at a plurality of preselected locations along the longitudinal axes of said rods, said clamp means including a pair of slip swivel clamps each having a U-shape with a bight portion and two legs extending therefrom in parallel spaced apart relationship, a bore extending through said bight portion and having a cross section preselected to slidably receive said rods when said legs are substantially parallel and to clamp said rods when said legs are moved toward one another, openings in said legs in mutual alignment with one another and having a common axis spaced from and perpendicular to the axis of said rod receiving bores, a bolt means having a head means and a threaded end, and threaded nut means, said bolt means being insertable into said openings and held therein under tension through coaction between said nut means and said threaded end;

wherein said shooting rest is assembled by each of said rods being inserted in said rod receiving bores of said pair of clamps, by placing said slip swivel clamps in adjacent relationship with said common axes in alignment, and by inserting said bolt means through said openings into threaded engagement with said nut means so as to apply force to said legs to move said legs toward one another and thus cause clamping of said rods as aforesaid.

2. Apparatus of claim 1 further characterized by said preselected cross sections of said rods and said bores being circular.

3. Apparatus of claim 1 further characterized by extension rod means connected to one of said ends of said rods.

4. Apparatus of claim 3 wherein said extension means are slidably connected to the lower ends of said rods.

5. Apparatus of claim 1 further including an elongated tubular member :positioned around each of said rods between said upper ends and said clamps.

6. Apparatus of claim 5 further characterized by said tubular members having an outer resilient surface.

7. Apparatus of claim 5 plus stop means attached to said ends whereby said members are retained in position and said lower ends have enhanced capability to rest on a supporting surface without slipping.

8. Apparatus of claim 1 characterized by said legs having planer and mutually substantially parallel outer surfaces whereby alternate assembly procedures are permitted, the first being with said bores being on the same side of said bolt means and the second being with said bores being on opposite sides of said bolt means to thereby provide, when said rods are clamped as aforesaid, first and second longitudinally spaced apart points of crossing of said longitudinal axes of said rods and hence a choice of arcuate spacing between said tubular members.

9. Apparatus of claim 5 further characterized by said tubular members being made of foam material.

10. Apparatus of claim 1 further characterized by gaps being defined between said legs of said slip swivel clamps and by said gaps being connected to said bores.

11. Apparatus of claim 3 wherein said extension rod means is an additional rod having attached at one end thereof a coupling.

12. Apparatus of claim 11 wherein said coupling may be slidably engaged by said one of said end of said rod.

* * * * *